US007872556B2

(12) United States Patent
Sano

(10) Patent No.: US 7,872,556 B2
(45) Date of Patent: Jan. 18, 2011

(54) MAGNETIC ELEMENT

(75) Inventor: Kan Sano, Tokyo (JP)

(73) Assignee: Sumida Corporation (JP)

( * ) Notice: Subject to any disclaimer, the term of this patent is extended or adjusted under 35 U.S.C. 154(b) by 0 days.

(21) Appl. No.: 12/545,327

(22) Filed: Aug. 21, 2009

(65) Prior Publication Data

US 2009/0315658 A1 Dec. 24, 2009

Related U.S. Application Data

(62) Division of application No. 11/796,390, filed on Apr. 27, 2007, now Pat. No. 7,741,942.

(30) Foreign Application Priority Data

Apr. 28, 2006 (JP) ..... 2006-126327

(51) Int. Cl.
*H01F 38/12* (2006.01)

(52) U.S. Cl. ..... 336/84 M

(58) Field of Classification Search ..... 336/65, 336/83, 200, 206–208, 223, 232, 84 R, 84 M, 336/212
See application file for complete search history.

(56) References Cited

U.S. PATENT DOCUMENTS

| | | | | |
|---|---|---|---|---|
| 3,287,678 | A | 11/1966 | Okamoto et al. | |
| 4,314,221 | A * | 2/1982 | Satou et al. | 336/83 |
| 4,400,674 | A | 8/1983 | Suda et al. | |
| 5,010,313 | A | 4/1991 | Kaneko et al. | |
| 5,307,557 | A | 5/1994 | Te-Hsueh | |
| 6,055,721 | A | 5/2000 | Mamada et al. | |
| 6,242,996 | B1 | 6/2001 | Sato et al. | |
| 6,566,993 | B1 | 5/2003 | Otsuka et al. | |
| 6,717,500 | B2 | 4/2004 | Girbachi et al. | |
| 6,965,289 | B2 | 11/2005 | Toi et al. | |
| 2009/0195345 | A1 | 8/2009 | Sano | |

FOREIGN PATENT DOCUMENTS

| | | |
|---|---|---|
| CN | 1881488 A | 12/2006 |
| GB | 2128816 | 5/1984 |
| JP | 10-303028 | 11/1998 |
| JP | 2006-073847 A | 3/2006 |

OTHER PUBLICATIONS

European Search Report, EP 07251744.
Office Action from corresponding Chinese Application No. 200710102973.6 issued Jul. 30, 2010.

* cited by examiner

*Primary Examiner*—Tuyen Nguyen
(74) *Attorney, Agent, or Firm*—Lerner, David, Littenberg, Krumholz & Mentlik, LLP

(57) ABSTRACT

A magnetic assembly includes a mounting substrate and a magnetic element mounted on the mounting substrate. The magnetic element includes a drum core provided with a flange portion at each end of a winding shaft, a coil wound on the winding shaft, and a shield core engaged with the drum core, the shield core including an engagement portion having a shape that corresponds to the shape of a portion of the outer circumference of at least one of the flange portions so that the engagement portion mates with the at least one flange portion.

11 Claims, 6 Drawing Sheets

MAGNETIC ELEMENT

CROSS REFERENCES TO RELATED APPLICATIONS

This application is a divisional of U.S. patent application Ser. No. 11/796,390, filed on Apr. 27, 2007, and claims priority to Japanese Patent Application No. P2006-filed on Apr. 28, 2006, the disclosures of which are hereby incorporated by reference herein.

BACKGROUND OF THE INVENTION

The present invention relates to a magnetic element and more particularly relates to an inductance element that is used for a power supply.

In the past, there have been known many magnetic elements which have such a structure that a rectangular or cylindrical ring core is disposed around a circular drum core having a coil wound on a winding shaft (refer to Japanese Unexamined Patent Publication No. 2006-73847, for example).

However, in the magnetic element having the above-described structure, the magnetic element becomes a large size since the rectangular or cylindrical ring core is disposed around the circular drum core and therefore the magnetic element becomes such a size that the dimension of the outside diameter of the drum core is added to the dimension in a radial direction of the ring core. Moreover, there is such a problem that the layout area of the magnetic element becomes large when the magnetic element is mounted on a substrate.

In addition, since the ring core surrounds the drum core, there is such a problem that an end portion of the coil wound on the winding shaft of the drum core is difficult to draw out toward a terminal side at the time of connecting the terminal and the coil.

SUMMARY OF THE INVENTION

According to an embodiment of the present invention, there is provided a magnetic element which is small in size and in which a coil and a terminal can be connected easily.

The problems such as those described hereinbefore can be solved by the following embodiments according to the present invention.

A magnetic element is configured to have a drum core provided with a flange portion having a flange surface at each end of a winding shaft, a coil wound on the above-described winding shaft, a terminal to connect with each end portion of the above-described coil, and a shield core provided with an engagement portion having such a shape that partially fits in along an outer circumference of the above-described flange portion.

In the magnetic element described above, the shield core may include a planar wall portion and a plurality of engagement portions that are formed in a manner being connected contiguously along this wall portion, and a plurality of drum cores may be engaged with the plurality of engagement portions.

In the magnetic element described above, there may be a relation of $$0.5 \times S1 \leqq S2 \leqq 5 \times S1$$

when a cross-sectional area of the winding shaft in a direction parallel to the flange surface is S1 and a cross-sectional area of the shield core in a direction parallel to the flange surface is S2.

The magnetic element according to the present invention is assembled such that the flange portion of the drum core is partially engaged with the shield core.

According to embodiments of the present invention, the size of the magnetic element can be reduced since the magnetic element is configured such that the flange portion of the drum core is partially engaged with the shield core. In addition, the task of connecting the coil and the terminal is facilitated since the end portion of the coil wound on the drum core can be easily drawn out.

DETAILED DESCRIPTION

Hereinafter, preferred embodiments of the present invention are explained by referring to the accompanying drawings, however, the present invention is not limited to those embodiments described hereinafter.

Figure 1:
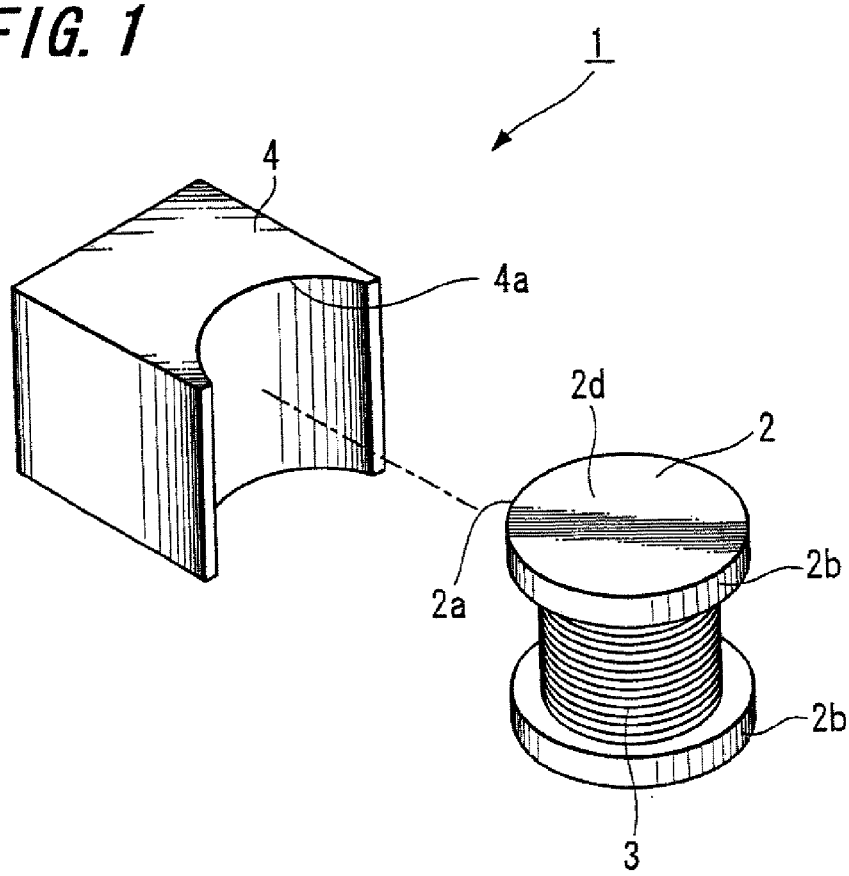
FIG. 1 is an exploded perspective view of a magnetic element according to a first embodiment of the present invention.

FIG. 1 is an exploded perspective view of a magnetic element according to a first embodiment of the present invention.

As shown in FIG. 1, an inductance element 1 as the magnetic element is configured to have a drum core 2, a coil 3 and a shield core 4.

The drum core 2 includes a winding shaft and flange portions 2*b* having planar flange surfaces 2*d*. The drum core 2 is made of a magnetic material using Ni—Zn type ferrite. Further, the coil 3 is wound on the winding shaft (not illustrated) that is connected contiguously with the flange portions 2*b*.

In addition, a terminal (not illustrated) to connect with each end portion of the coil 3 is provided in the drum core 2. The terminal may be formed such that a metallic terminal member is attached to the drum core or such that a terminal electrode is printed on the drum core by using Ag paste. Also, the terminal electrode may be provided in the shield core 4.

The shield core 4 is formed such that the height thereof approximately corresponds to the height of the drum core 2, and an engagement portion 4*a* having a shape that matches with an outer circumferential shape 2*a* of each flange portion 2*b* is formed on one surface opposing the drum core 2. In this embodiment, the engagement portion 4*a* is formed with a semi-cylindrical concave portion since the outer circumferential shape 2*a* of the flange portion 2*b* is circular. In addition, the engagement portion 4*a* is formed such that the length of the curved surface provided on the semi-cylindrical concave portion is ¼ to ½ of the total length of the outer circumference of the flange portion 2*b*. It should be noted that the shield core 4 is made of the material using Ni—Zn type ferrite and is molded into the prescribed shape by a die-pressing method, for example.

Figure 2:
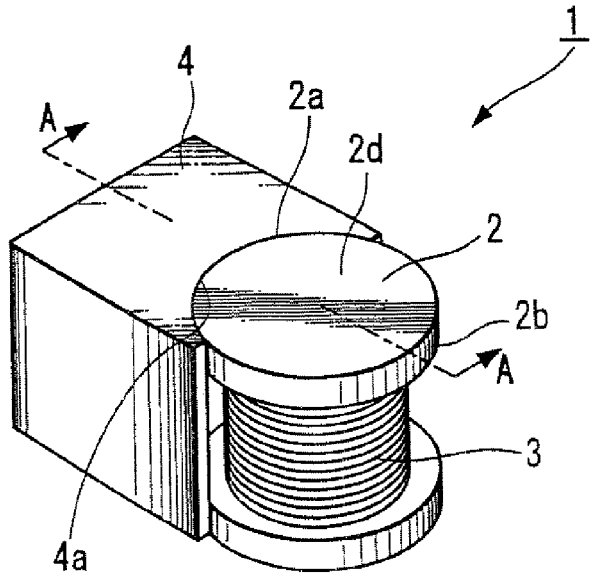
FIG. 2 is a perspective view of the magnetic element according to the first embodiment of the present invention.

FIG. 2 is a perspective view of the magnetic element according to this embodiment.

As shown in FIG. 2, the inductance element 1 is assembled such that the outer circumference 2*a* of each flange portion 2*b* of the drum core 2 is partially engaged with the engagement portion 4*a* of the shield core 4. It should be noted that the inductance element 1 is assembled such that each flange surface 2*d* and each of the upper and lower surfaces of the shield core 4 form one planar surface. In addition, the drum core 2 and the shield core 4 are fixed together by applying an adhesive to a side surface of each flange portion 2*b* and to a desired portion of the shield core 4 corresponding to the above-described side surface at the time of assembling together the drum core 2 and the shield core 4.

A closed magnetic circuit is formed in the inside of the inductance element 1 since the drum core 2 and the shield core 4 are assembled in this manner. It should be noted that the shield core 4 has a function as a magnetic shield core to prevent leakage of the magnetic flux since the shield core 4 passes the magnetic flux entering from the drum core 2.

Meanwhile, it is necessary to provide a gap in the magnetic path in order to use the inductance element 1 for a power supply, more specifically for an application corresponding to large electric current. Here, one method of forming an air gap between the drum core 2 and the shield core 4 is to make the outer diameter of at least one flange portion 2*b* of the drum core 2 smaller than the outer diameter of the other flange portion 2*b*. Another method is to set the effective magnetic permeability of the shield core 4 lower than the effective magnetic permeability of the drum core 2 to realize a practical action as the gap. When such method is used, various alterations are possible such that a magnetic material of low magnetic permeability and a material made of a mixture of resin and magnetic powder, for example, are used as the core materials.

Figure 3:
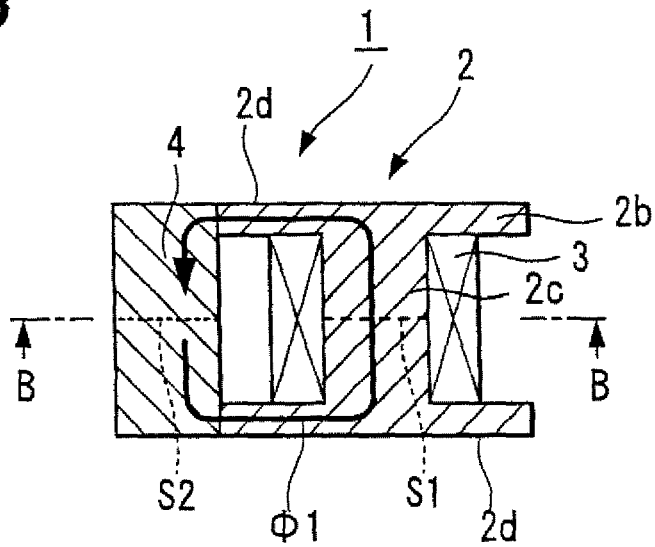
FIG. 3 is an A-A line cross-sectional view of the magnetic element shown in FIG. 2.

FIG. 3 is an A-A line cross-sectional view of the magnetic element shown in FIG. 2.

As shown in FIG. 3, the coil 3 is wound on the winding shaft 2*c* of the drum core 2. In addition, a magnetic flux Φ1 penetrating through the winding shaft 2*c*, the flange portions 2*b* and the shield core 4 in an arrow direction shown in this figure is generated from the coil 3. It should be noted that the flow direction of the magnetic flux in the element changes depending on the direction of the electric current flowing in the coil 3.

Here, a definition is given such that the cross-sectional area of the winding shaft 2*c* parallel to the flange surface 2*d* is S1 and the cross-sectional area of the shield core 4 which is parallel to the flange surface 2*d* and the narrowest portion thereof as shown in this figure (cross-sectional area at a height of ½ of the shield core 4 in this embodiment) is S2. It should be noted that the value of S2 is always constant in the inductance element 1 of this embodiment since the cross-sectional plane of the shield core 4 has a constant shape.

In the inductance element 1 of this embodiment, a relation of the cross-sectional area S1 and the cross-sectional area S2 is set into the relation of $0.5\times S1 \leqq S2 \leqq 5\times S1$.

Figure 4:
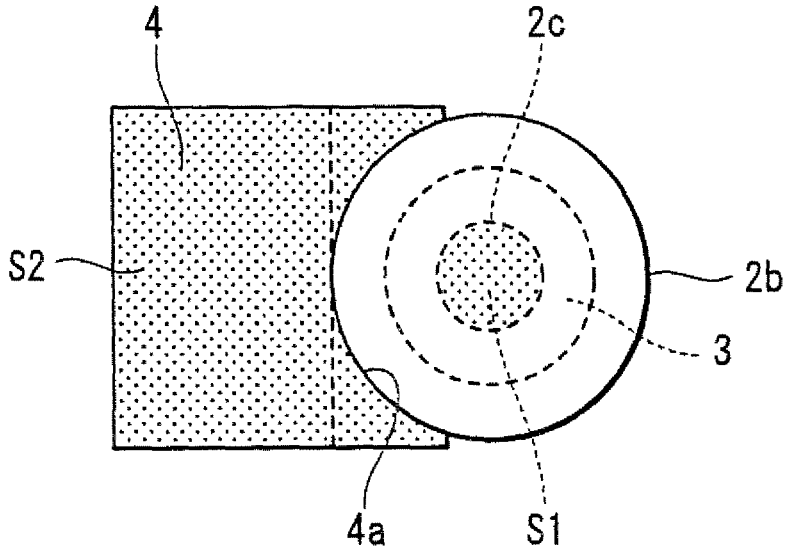
FIG. 4 is a B-B line cross-sectional view of the magnetic element shown in FIG. 3.

FIG. 4 is a B-B line cross-sectional view of the magnetic element shown in FIG. 3.

The coil 3 is wound on the winding shaft 2*c* whose cross-sectional area is S1. The flange portion 2*b* is configured such that the outer diameter thereof is larger than the outer diameter of the wound coil 3.

In addition, the engagement portion 4*a* provided in the shield core 4 is partially engaged with the outer circumference of each flange portion 2*b* of the drum core 2 such that the drum core 2 and the shield core 4 are mutually in contact. As described hereinbefore, the length of each contact portion of the flange portion 2*b* and shield core 4 is within the range of ¼ to ½ of the total length of the outer circumference of the flange portion 2*b*. Since the length of the contact portion is set within such range, the strength for the shield core 4 to hold the drum core 2 can be maintained sufficiently and the layout area of the inductance element 1 can be reduced when the inductance element 1 is mounted on a substrate.

Here, in a case that a contact area of the flange portion 2*b* and the shield core 4 is small as in a case of point contact, for example, a state of magnetic saturation occurs soon after the electric current flows in the inductance element. However, since the inductance element 1 of this embodiment is formed such that the shape of the engagement portion 4*a* of the shield core 4 matches with the shape of the flange portion 2*b* of the drum core 2, a ratio of the magnetic saturation generated in the shield core 4 and the magnetic saturation generated in the drum core 2 can be set equal so that a state of local magnetic saturation to be generated in the inside of the inductance element can be delayed.

In addition, since both of the drum core 2 and the shield core 4 have simple structures according to the inductance element 1 of this embodiment, manufacturing of the element is easy and manufacturing costs can be lowered.

Further, according to the inductance element 1 of this embodiment, the relation between the cross-sectional area S1 and the cross-sectional area S2 is set into $0.5\times S1 \leqq S2 \leqq 5\times S1$ when the cross-sectional area of the winding shaft 2*c* of the drum core 2 is S1 and the cross-sectional area of the shield core 4 is S2, and therefore the occurrence of the magnetic saturation to be generated in the inside of the drum core 2 and the shield core 4 can be delayed so that a fluctuation in the electric characteristic of the inductance element can be suppressed even if the inductance element 1 is used for various applications. Here, in this embodiment, the cross-sectional area S2 is set equal to or less than five times the cross-sectional area S1 in order to reduce the mounting area of the substrate, however the cross-sectional area S2 may be set equal to or more than five times the cross-sectional area S1 in order to improve the structural strength of the core.

Figure 5:
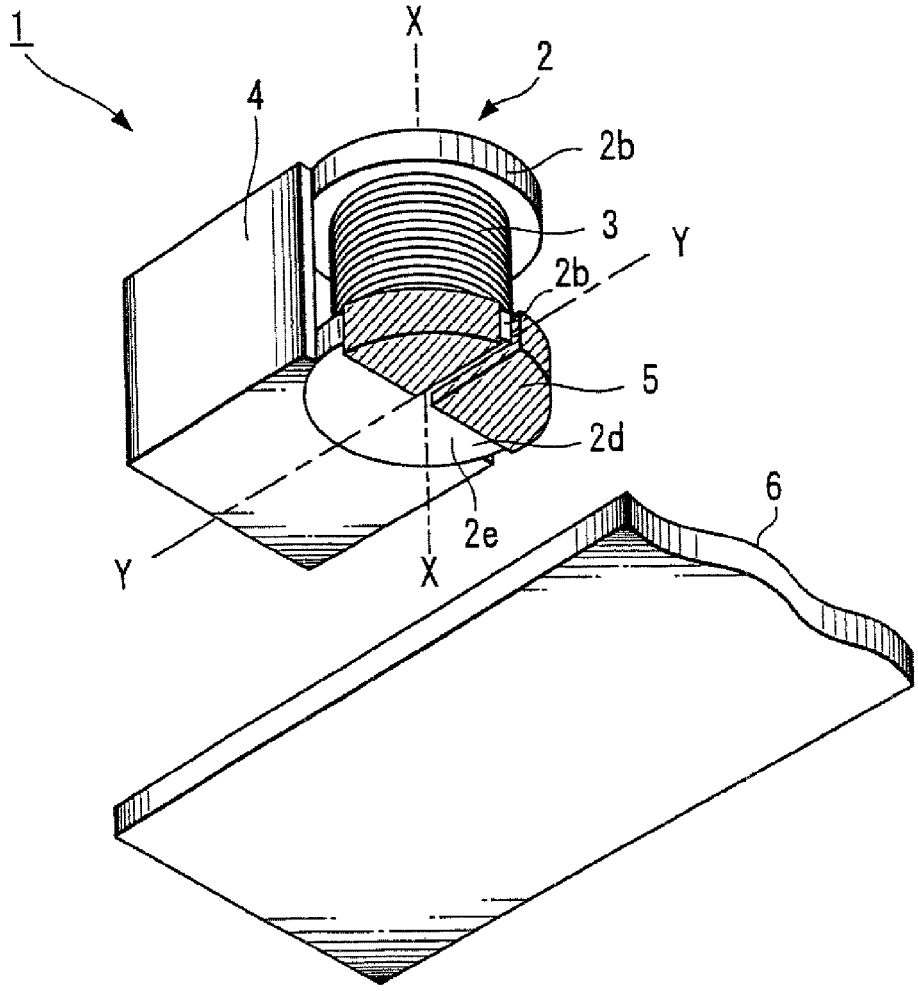
FIG. 5 is a perspective view when the magnetic element according to the first embodiment of the present invention is mounted on a mounting substrate.

FIG. 5 is a perspective view when the magnetic element according to the embodiment of the present invention is mounted on a mounting substrate.

In FIG. 5, the same reference numerals are given to those corresponding to FIG. 2 and duplicated explanations thereof are omitted.

As shown in FIG. 5, each terminal electrode 5 is formed on a mounting plane 2*e* provided in the flange surface 2*d* of the drum core 2. Each end portion (not illustrated) of the coil 3 wound on the winding shaft 2*c* is connected with the terminal electrode 5. In addition, the inductance element 1 is mounted on a mounting substrate 6 in a state that the contact between the terminal electrode 5 and the mounting substrate 6 is kept by soldering. Thereby, the electric current supplied from the mounting substrate 6 is supplied to the inductance element 1 through the terminal electrode 5.

According to the inductance element 1 of this embodiment, the length of each contact portion of the flange portion 2*b* and shield core 4 is set in a range of ¼ to ½ of the total length of the outer circumference of the flange portion 2*b*, and therefore not all of the drum core 2 is enclosed in the shield core 4. Therefore, the task of drawing out the end portion of the coil 3 and connecting the end portion with the terminal electrode 5 can be easily carried out since the end portion of the coil 3 that is wound on the winding shaft 2*c* can be visually recognized from the portion not enclosed in the shield core 4.

In addition, the X-X line shown by an alternate long and short dash line in the figure indicates a longitudinal direction of the winding shaft 2*c* (not illustrated) of the drum core 2. Also, the Y-Y line shown by the alternate long and short dash line in the figure indicates a direction parallel with the mounting plane 2*e*. More specifically, the inductance element 1 is mounted on the substrate 6 in such a state that the longitudinal axis of the winding shaft 2*c* of the drum core 2 is vertical to the mounting plane 2*e* according to this embodiment. As a result, leakage of the magnetic flux in the vertical direction of the inductance element 1 can be suppressed by the flange surface 2*d*, and therefore a malfunction of an electronic component used for signal processing, which is caused by the magnetic flux that leaks in the vertical direction, can be reduced in a case that the element is used for a multilayered circuit structure and the like which are configured such that a signal circuit substrate is disposed in the vertical direction of a power-supply circuit substrate, for example.

Figure 6:
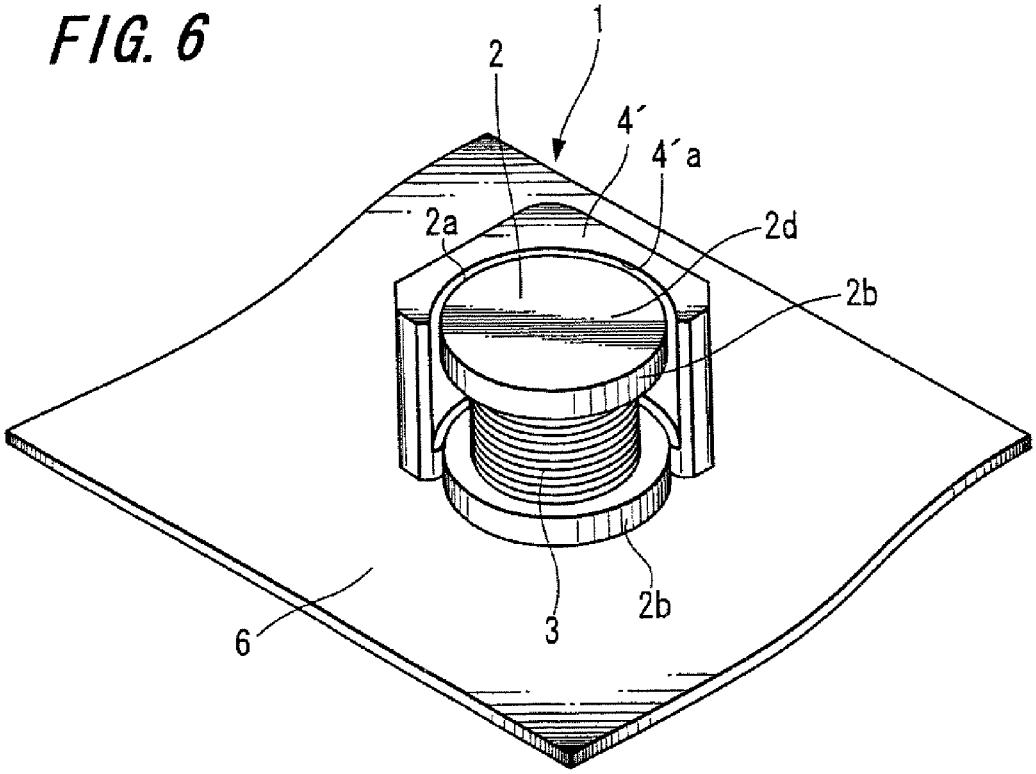
FIG. 6 is a perspective view when a magnetic element according to a second embodiment of the present invention is mounted on a mounting substrate.

FIG. 6 is a perspective view when a magnetic element according to a second embodiment of the present invention is mounted on a mounting substrate.

In FIG. 6, the same reference numerals are given to those corresponding to FIG. 2 and duplicated explanations thereof are omitted.

As shown in FIG. 6, a shield core 4' in this embodiment is formed such that the height thereof approximately corresponds to the height of the drum core 2, and an engagement portion 4'*a* having a shape that matches with the outer circumferential shape 2*a* of the flange portion 2*b* is formed on one surface opposing the drum core 2. In this embodiment, the engagement portion 4'*a* is formed with a semi-cylindrical concave portion since the outer circumferential shape 2*a* of the flange portion 2*b* is circular.

In addition, the shield core 4' is formed with such a size that the width in a radial direction of the flange portion 2*b* is approximately the same along the outer circumference of the flange portion 2*b*. Thereby, the shield core 4' can be made into a small size, and therefore the layout area of the inductance element 1 on the substrate can be reduced.

In addition, the engagement portion 4'*a* is formed such that the length of the curved surface provided on the semi-cylindrical concave portion is approximately ½ of the total length of the outer circumference of the flange portion 2*b*. It should be noted that the shield core 4' is made of the material using Ni—Zn type ferrite and is molded into the prescribed shape by a die-pressing method, for example.

Figure 7:
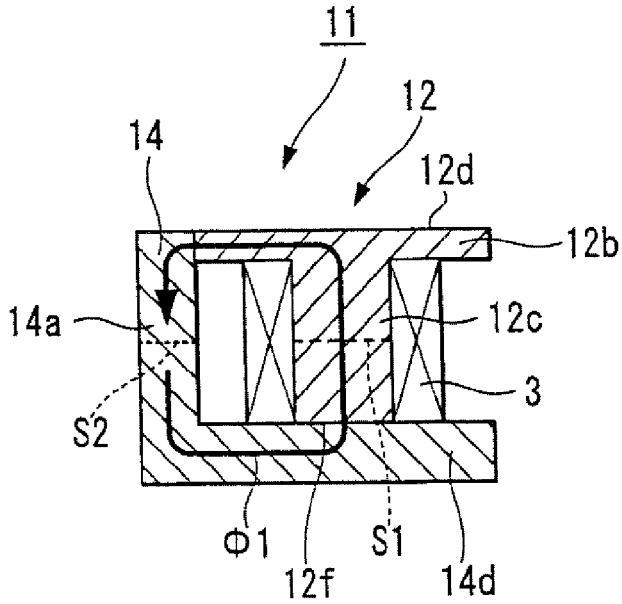
FIG. 7 is a cross-sectional view of a magnetic element according to a third embodiment of the present invention.

FIG. 7 is a cross-sectional view of a magnetic element according to a third embodiment of the present invention.

In FIG. 7, the same reference numerals are given to those corresponding to FIG. 3 and duplicated explanations thereof are omitted.

As shown in FIG. 7, an inductance element 11 is configured to have a so-called T-shaped drum core 12, a coil 3 wound on a winding shaft 12*c* of the drum core, and a shield core 14.

The drum core 12 includes a winding shaft 12*c* and a flange portion 12*b* that is connected contiguously with only one end of the winding shaft 12*c*.

The shield core 14 includes a main body portion 14*a* that opposes the drum core 12 and a tabular seat portion 14*d* that is connected contiguously with the bottom side of the main body portion 14*a*, and the shield core 14 is formed such that a cross-sectional plane thereof has a so-called L-shape as shown in the figure. The inductance element 11 is assembled such that an end portion 12*f* of the winding shaft 12*c* on the side having no flange portion 12*b* formed thereon is mounted on the seat portion 14*d* of the shield core 14.

Figure 8:
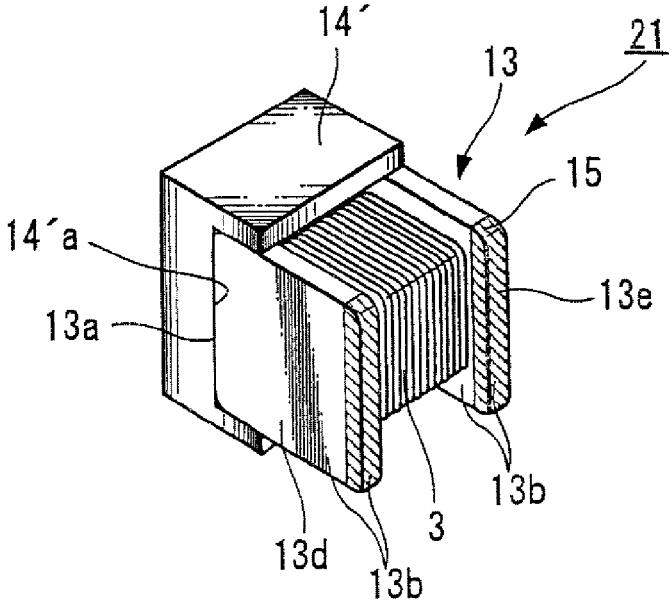
FIG. 8 is a perspective view of a magnetic element according to a fourth embodiment of the present invention.

FIG. 8 is a perspective view of a magnetic element according to a fourth embodiment of the present invention.

As shown in FIG. 8, a drum core 13 includes a winding shaft (not illustrated) and flange portions 13*b* having approximately square flange surfaces 13*d* that are connected contiguously with this winding shaft. In addition, a coil 3 is wound on the winding shaft. It should be noted that the drum core 13 is made of a magnetic powder material using Ni—Zn type ferrite.

A shield core 14' is formed such that the height thereof approximately corresponds to the height of the drum core 13 in the direction of the winding shaft, and an engagement portion 14'*a* having a shape that matches with an outer circumferential shape of each flange portion 13*b* is formed on one surface opposing the drum core 13. In this embodiment, the outer circumferential shape of the flange portion 13*b* is square, and therefore a rectangular parallelepiped-shaped concave portion is formed on the engagement portion 14'*a*. The shield core 14' is made of the material using Ni—Zn type ferrite and is molded into the prescribed shape by a die-pressing method, for example. It should be noted that the shield core 14' may be made of an adhesive containing a magnetic substance.

The inductance element 21 is assembled such that an outer circumference 13*a* of each flange portion 13*b* is partially engaged with the engagement portion 14'*a* of the shield core 14'. The length of each contact portion of the flange portion 13*b* and shield core 14' is set in a range of ¼ to ½ of the total length of the outer circumference of the flange portion 13*b*. Since the length of the contact portion is set within such range, the holding strength between the drum core 13 and the shield core 14' can be maintained sufficiently and the layout area of the inductance element 12 can be reduced when the inductance element 12 is mounted on a substrate.

It should be noted that the drum core 13 and the shield core 14' are fixed together by applying an adhesive to a side surface of each flange portion 13*b* and to a desired portion of the shield core 14' corresponding to the above-described side surface at the time of assembling together the drum core 13 and the shield core 14'. As a result, a closed magnetic circuit is formed by the drum core 13 and the shield core 14' in the inductance element 21.

In addition, the inductance element 21 is set such that the relation between the cross-sectional area S1 and the cross-sectional area S2 is $0.5 \times S1 \leqq S2 \leqq 5 \times S1$ when the cross-sectional area of the winding shaft parallel to the flange surface 13*d* is S1 and the cross-sectional area of the shield core 14' which is parallel to the flange surface 13*d* and the narrowest portion thereof is S2.

A terminal electrode 15 is provided in a mounting plane 13*e* of each flange portion 13*b*. The terminal electrode 15 is formed such that Ag paste is applied and baked on each mounting plane 13*e*. As described hereinbefore, the core is built into such a type that each electrode is formed by applying and baking the Ag paste on a portion that becomes the electrode, and thereby the productivity and the mountability onto the substrate can be improved. In addition, the inductance element 21 is mounted on the mounting substrate 6 such that the terminal electrode 15 is soldered and fixed to the mounting substrate, and therefore the electric current supplied from the substrate is supplied to the inductance element 21 through the terminal electrode 15.

According to the inductance element 21 of this embodiment, each flange portion 13*b* has an approximately square shape so that the mountability and stability can be improved at the time of mounting the inductance element on the substrate. In addition, the height of the inductance element 21 can be lowered at the time of installing the inductance element on the substrate so that an overall size reduction can be achieved.

Figure 9:
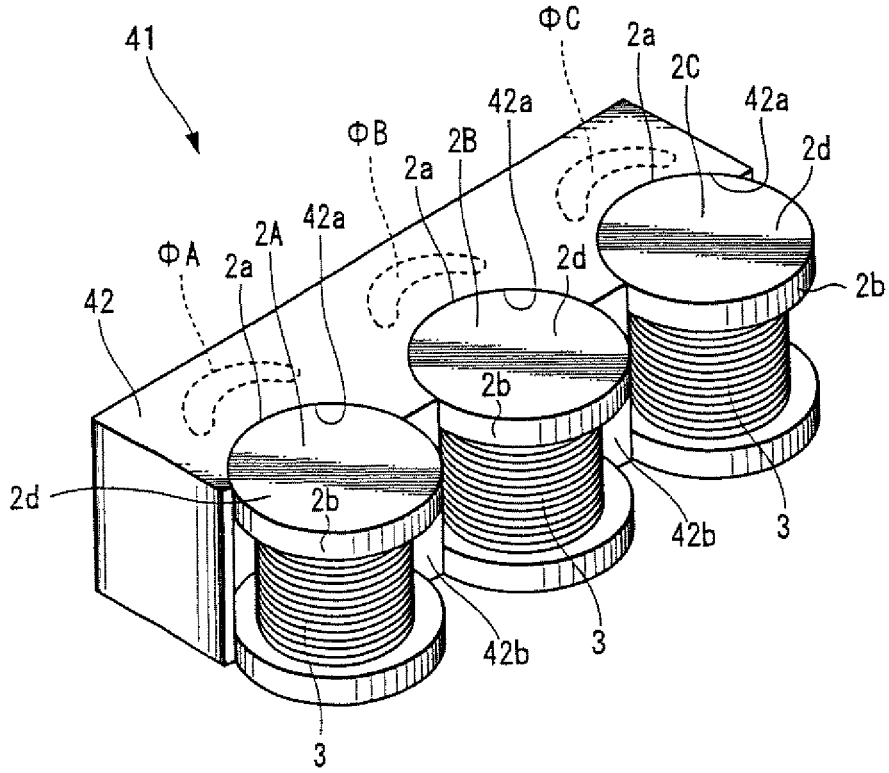
FIG. 9 is a perspective view of a magnetic element according to a fifth embodiment of the present invention.

FIG. 9 is a perspective view of a magnetic element according to a fifth embodiment of the present invention.

As shown in FIG. 9, an inductance element 41 of this embodiment includes a plurality of drum cores 2A, 2B and 2C having coils 3 respectively wound thereon and a shield core 42. The drum cores 2A, 2B and 2C are configured to have mutually the same shapes. In addition, the drum cores 2A, 2B and 2C are made of the magnetic material using Ni—Zn type ferrite.

The shield core 42 is formed such that the height thereof approximately corresponds to the height of the drum cores 2, and a wall portion 42*b* having a planar surface is formed on the side opposing the drum cores 2A, 2B and 2C. Engagement portions 42*a* each having a shape that partially matches with the outer circumferential shape 2*a* of each flange portion 2*b* of the drum cores are formed at plural places in the wall portion 42*b*. In this embodiment, since the outer circumferential shape 2*a* of each flange portion 2*b* is made into a circular shape, a semi-cylindrical concave portion is formed in each engagement portion 42*a*. In addition, since three drum cores 2A, 2B and 2C need to be engaged with the shield core 42, the engagement portions 42*a* are formed at three places in a manner being connected contiguously along the wall portion 42*b*. Here, the shield core 42 is made of the material using Ni—Zn type ferrite and molded into the prescribed shape by a die-pressing method, for example. It should be noted that the shield core 42 may be made of an adhesive containing the magnetic substance.

The inductance element 41 is assembled such that the outer circumference 2*a* of each flange portion 2*b* in each of the drum cores 2A, 2B and 2C is partially engaged with an engagement portion 42*a* of the shield core 42. The length of each contact portion of the flange portion 2*b* and shield core 41 is set in a range of ¼ to ½ of the total length of the outer circumference of each flange portion 2*b*. Since the length of the contact portion is set within such range, the strength for the shield core 42 to hold the drum cores 2A, 2B and 2C can be maintained sufficiently and the layout area of the inductance element 41 can be reduced when the inductance element 41 is mounted on a substrate. It should be noted that each of the drum cores 2A, 2B, 2C and the shield core 42 are fixed together by applying an adhesive to a side surface of each flange portion 2*b* and to a desired portion of the shield core 42 corresponding to the above-described side surface at the time of assembling together each of the drum cores 2A, 2B, 2C and the shield core 42.

The terminal to connect the coil may be formed such that a metallic terminal member is attached to each drum core. Also, the terminal may be formed such that the terminal electrode is printed on the mounting surface of the drum core by using Ag paste. It should be noted that the terminal electrode may be provided in the shield core 42.

Since the inductance element 41 of this embodiment is configured such that one shield core 42 and three drum cores 2A, 2B and 2C are combined together, closed magnetic circuits are formed at three places in one inductance element 41 and respective magnetic flux paths ΦA, ΦB and ΦC penetrating through the winding shafts 2*c*, flange portions 2*b* and shield core 42 are generated independently. Each of the magnetic paths ΦA, ΦB and ΦC is generated in a direction along the longitudinal axis of the winding shaft of each drum core in the shield core 42 as shown in the figure. It should be noted that the flow direction of the magnetic flux in the inductance element changes depending on the direction of the electric current flowing in the coil 3 that is wound on each drum core.

According to the inductance element 41 of this embodiment, since respective independent magnetic flux paths can be formed for each of the drum cores 2A, 2B and 2C as described hereinbefore, each magnetic flux is rarely intermingled so that the stable electric characteristic of the inductance element 41 can be maintained even though a plurality of drum cores are used.

It should be noted that the number of drum cores to be engaged with the shield core is not limited to three pieces as described in this embodiment, but the number of drum cores may be two pieces or may be four pieces or more. In this case, the same number of engagement portions as the drum cores are formed in the shield core. Also, drum cores having an approximately square flange portion may be used as the drum cores in this embodiment.

In addition, the inductance element may be built such that the plurality of drum cores are made into so-called T-shaped drum cores. Further, a tabular seat portion 14*d* may be provided on the bottom side of the wall portion 42*b* such that a cross-sectional plane of the shield core has an L-shape, and the T-shaped drum cores may be mounted on the seat portion.

Figure 10:
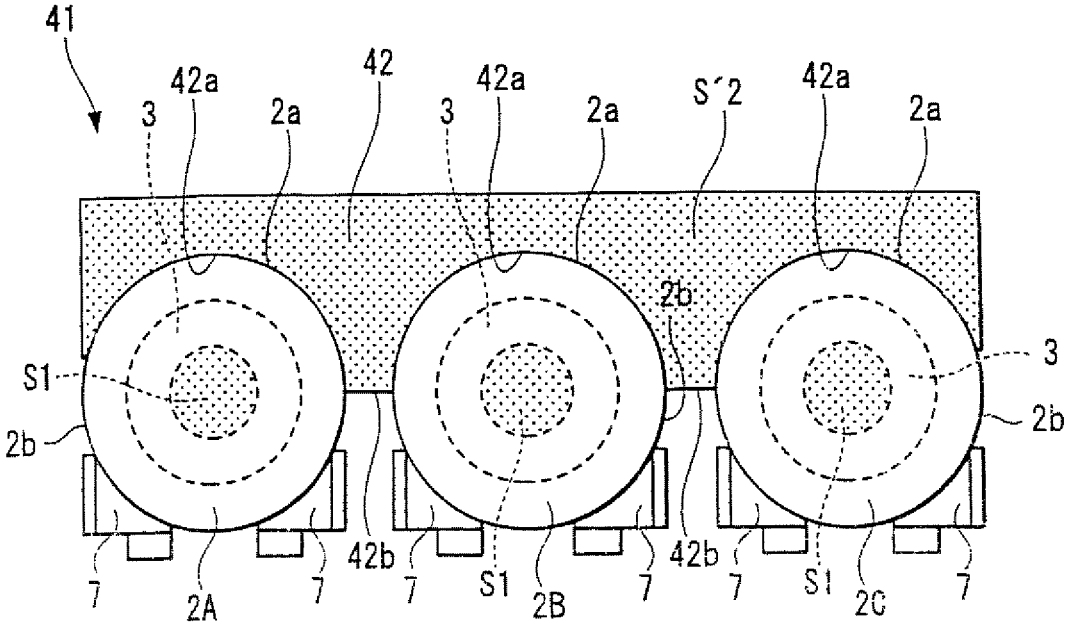
FIG. 10 is a top plan view of the magnetic element shown in FIG. 9.

FIG. 10 is a top plan view of the magnetic element shown in FIG. 9.

In FIG. 10, the same reference numerals are given to those corresponding to FIG. 9 and duplicated explanations thereof are omitted.

As shown in FIG. 10, the coil 3 is wound on the winding shaft 2*c* of each of drum cores 2A, 2B and 2C, and each flange portion 2*b* has a larger outer diameter than the outer diameter of the wound coil 3.

In addition, each terminal 7 that is a user terminal or binding terminal is connected with the lower side of each drum core. The terminal 7 may be formed integrally with the substrate on which the drum core is mounted or may be formed as a terminal member that is molded separately.

Here, the inductance element 41 is configured such that a relation of cross-sectional area S'1 and cross-sectional area S'2 is $0.5\times S'1 \leqq S'2 \leqq 5\times S'1$ when the area obtained by adding up the cross-sectional areas S1 of the winding shafts parallel to the flange surfaces 2*d* of the respective drum cores is S'1 and the cross-sectional area of the shield core 42 which is parallel to the flange surface 2*d* and the narrowest portion thereof is S'2.

According to the inductance element 41 of this embodiment, the relation of the cross-sectional area S'1 and cross-sectional area S'2 is set into $0.5\times S'1 \leqq S'2 \leqq 5\times S'1$ as described hereinbefore when the area obtained by adding up the cross-sectional areas S1 of the winding shafts 2*c* of the plural drum cores 2 is S'1 and the cross-sectional area of the shield core 42 is S'2, and therefore the occurrence of magnetic saturation to be generated in the inside of each drum core of 2A, 2B, 2C and shield core 42 is delayed so that fluctuations in the electric characteristic of the inductance element can be suppressed even if the inductance element 41 is used for various applications. Additionally, at the same time, the layout area of the inductance element 41 on the substrate can be reduced while maintaining the strength of the element. Here, the shield core 42 may be made of an adhesive containing the magnetic substance.

It should be noted that the magnetic element according to the embodiments of the present invention is not limited to the above-described embodiments and it is apparent that various alterations and modifications in materials, configurations, and the like besides those described herein are possible within the scope and the spirit of the present invention. Especially, the magnetic material used to form the above-described drum core and shield core is not limited to the Ni—Zn type ferrite but it is possible to use a material such as Mn—Zn type ferrite, metal type magnetic material, and amorphous type magnetic material.

Having described preferred embodiments of the invention with reference to the accompanying drawings, it is to be understood that the invention is not limited to those precise embodiments and that various changes and modifications could be effected therein by one skilled in the art without departing from the spirit or the scope of the invention as defined in the appended claims.

The invention claimed is:

1. A magnetic assembly, comprising:

a mounting substrate; and a magnetic element mounted on the mounting substrate, the magnetic element including a drum core including a winding shaft and a flange portion at each end of the winding shaft, each flange portion including a flange surface;

a coil wound on the winding shaft; and a shield core engaged with the drum core, the shield core including an engagement portion having a shape that corresponds to the shape of a portion of an outer circumference of at least one of the flange portions so that the engagement portion mates with the at least one flange portion, and $$0.5\times S1 \leqq S2 \leqq 5\times S1$$

where S1 is a cross-sectional area of the winding shaft in a direction parallel to the flange surface, and S2 is a cross-sectional area of the shield core in the direction parallel to the flange surface.

2. The magnetic assembly according to claim 1, wherein the engagement portion mates with ¼ to ½ of the total circumference of the at least one flange portion.

3. The magnetic assembly according to claim 1, further comprising a terminal electrode interposed between the mounting substrate and one of the flange portions.

4. The magnetic assembly according to claim 3, wherein the terminal electrode is printed on the one flange portion.

5. The magnetic assembly according to claim 1, wherein the winding shaft has a longitudinal axis and the mounting substrate has a surface extending in a plane, the magnetic element being mounted on the mounting substrate such that the longitudinal axis of the winding shaft is oriented orthogonally to the plane.

6. The magnetic assembly according to claim 1, wherein the drum core has a height from the mounting substrate, and the shield core has a height from the mounting substrate which is approximately the same as the height of the drum core.

7. The magnetic assembly according to claim 1, wherein the magnetic element further includes an air gap between the drum core and the shield core.

8. The magnetic assembly according to claim 7, wherein the at least one flange portion has a first diameter and another of the flange portions has a diameter less than the first diameter, whereby when the engagement portion mates with the at least one flange portion, the air gap will be defined between the engagement portion and the another flange portion.

9. A magnetic assembly, comprising:

a mounting substrate; and a magnetic element mounted on the mounting substrate, the magnetic element including a drum core including a winding shaft and a flange portion at each end of the winding shaft;

a coil wound on the winding shaft; and a shield core engaged with the drum core, the shield core including an engagement portion having a shape that corresponds to the shape of a portion of an outer circumference of at least one of the flange portions so that the engagement portion mates with ¼ to ½ of the total circumference of the at least one flange portion.

10. A magnetic assembly, comprising:

a mounting substrate; and a magnetic element mounted on the mounting substrate, the magnetic element including a drum core including a winding shaft and a flange portion at each end of the winding shaft;

a coil wound on the winding shaft;

a shield core engaged with the drum core, the shield core including an engagement portion having a shape that corresponds to the shape of a portion of an outer circumference of at least one of the flange portions so that the engagement portion mates with the at least one flange portion; and a terminal electrode printed on one of the flange portions between the mounting substrate and the one flange portion.

11. A magnetic assembly, comprising:

a mounting substrate; and a magnetic element mounted on the mounting substrate, the magnetic element including a drum core including a winding shaft and a flange portion at each end of the winding shaft;

a coil wound on the winding shaft;

a shield core engaged with the drum core, the shield core including an engagement portion having a shape that corresponds to the shape of a portion of an outer circumference of at least one of the flange portions so that the engagement portion mates with the at least one flange portion; and an air gap between the drum core and the shield core, wherein the at least one flange portion has a first diameter and another of the flange portions has a diameter less than the first diameter, whereby when the engagement portion mates with the at least one flange portion, the air gap will be defined between the engagement portion and the another flange portion.

* * * * *